United States Patent [19]

Swain et al.

[11] Patent Number: 4,527,734

[45] Date of Patent: Jul. 9, 1985

[54] SUBZONE DIVERTER CONTROL

[75] Inventors: Roy E. Swain, Fayetteville; William E. Clark, Syracuse, both of N.Y.

[73] Assignee: Carrier Corporation, Syracuse, N.Y.

[21] Appl. No.: 562,895

[22] Filed: Dec. 19, 1983

[51] Int. Cl.[3] ..... F24F 13/10

[52] U.S. Cl. ..... 236/49; 62/187

[58] Field of Search ..... 236/49; 62/187; 165/22

[56] References Cited

U.S. PATENT DOCUMENTS

| | | | |
|---|---|---|---|
| 2,790,372 | 4/1957 | Cooper | 236/49 X |
| 3,743,180 | 7/1973 | Perkins et al. | 236/49 X |
| 3,780,941 | 12/1973 | Blackwell | 236/49 |
| 4,086,781 | 5/1978 | Brody et al. | 236/49 X |
| 4,231,513 | 11/1980 | Vance et al. | 236/49 |
| 4,272,966 | 6/1981 | Niemann et al. | 236/49 X |
| 4,407,445 | 10/1983 | Vivian | 236/49 |

*Primary Examiner*—William E. Tapolcai

*Attorney, Agent, or Firm*—David J. Zobkiw

[57] ABSTRACT

A zone whose air supply volume and character is responsive to temperature data supplied from a single location in the zone is made responsive to the requirements of a subzone remote from the sensor location. The air supply to the subzone is changed responsive to an unsatisfied condition therein resulting in a changed supply to the area in which the sensor is located. As a result, the sensor responds to the changed air supply by indicating an unsatisfied condition to which the system responds by changing the amount of air supplied to the zone.

5 Claims, 5 Drawing Figures

SUBZONE DIVERTER CONTROL

BACKGROUND OF THE INVENTION

In large buildings, such as office buildings, the core of the building is generally isolated from external environmental conditions. As a result, the core of a building is usually cooled year-round due to the heating load of the lights, machinery and personnel while the periphery of the building is heated or cooled, as required. Thus, in such buildings, there is ordinarily a concurrent demand for cooling and heating and/or neutral air to provide temperature regulation and to overcome air stagnation.

Various configurations have been employed to meet the differing demands of different parts of the system. In constant volume systems, a constant delivery fan is used to provide a constant air flow with the character/temperature of the flow being thermostatically controlled. In variable volume systems, many means are used to control fan volume. The fan speed of a variable speed fan can be varied to maintain static pressure requirements while the individually controlled dampers regulate the flow in each zone. Other means of control are riding the fan curve, using inlet guide vanes and using discharge dampers. Additionally, in conventional variable volume systems, only cooled or neutral air is circulated in the system. At locations where heating is required, a local heat source, such as an electric resistance heater, is provided. The air to be heated is provided from a separate source, such as the ceiling plenum, and requires additional fans.

In variable air volume systems where the air flow to each zone is controlled at the conditioning unit, each zone generally has a plurality of air outlets but a single sensor. The single sensor determines the amount of neutral or conditioned air supplied to each zone and is influenced by the cumulative flow through the various air outlets in each zone. The satisfactory operation of such a system requires that the demand required by each air outlet be somewhat uniform. Contrary to this requirement is, for example, a conference room located in a zone and defining a subzone. The infrequent use of such a room, coupled with high attendance when used, would generally find the room in either an overcooled-/overheated condition or unsatisfied. An unsatisfied cooling condition would be exacerbated if the occupants of the zone were concentrated in the conference room since demand would be lessened at the zone sensor location. Other areas are corner rooms which have different sun loads, wind exposure etc., than occur in some or all of the other parts of the zone.

SUMMARY OF THE INVENTION

The present invention is directed to a subzone control which makes a zone sensor responsive to conditions in a subzone in an area remote from the zone sensor. More specifically, the delivery of neutral or conditioned air is diverted to the subzone requiring an increased delivery at the expense of the area in which the zone sensor is located. Since the zone sensor will indicate a need for a greater delivery to the zone, the air handling unit will be required to increase the delivery and thereby provide sufficient flow for the entire zone including the subzone.

It is an object of this invention to provide a method and apparatus for providing a subzone with required amounts of neutral or conditioned air.

It is another object of this invention to provide a method and apparatus for providing a sufficient flow of neutral or conditioned air to a subzone or area remote from a zone sensor.

It is a further object of this invention to provide an increased flow of neutral or conditioned air to a zone to accomodate increased demand in a subzone remote from the zone sensor.

It is an additional object of this invention to divert the flow of neutral or conditioned air in a zone such as to change the zone sensor's input to the control for the air handling unit. These objects, and others as will become apparent hereinafter, are accomplished by the present invention.

Basically, the delivery of neutral or conditioned air to a zone is at least partially diverted at a point upstream of a zone sensor. The diversion is in response to a need for an increased delivery of neutral or conditioned air to a subzone or area remote from the zone sensor. The resultant reduced delivery to the area in which the zone sensor is located causes the zone sensor to indicate a need for an increased delivery of air to the zone. Responsive thereto, the air handler is caused to increase the delivery of neutral or conditioned air to the zone so as to provide sufficient flow to the entire zone including the subzone.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
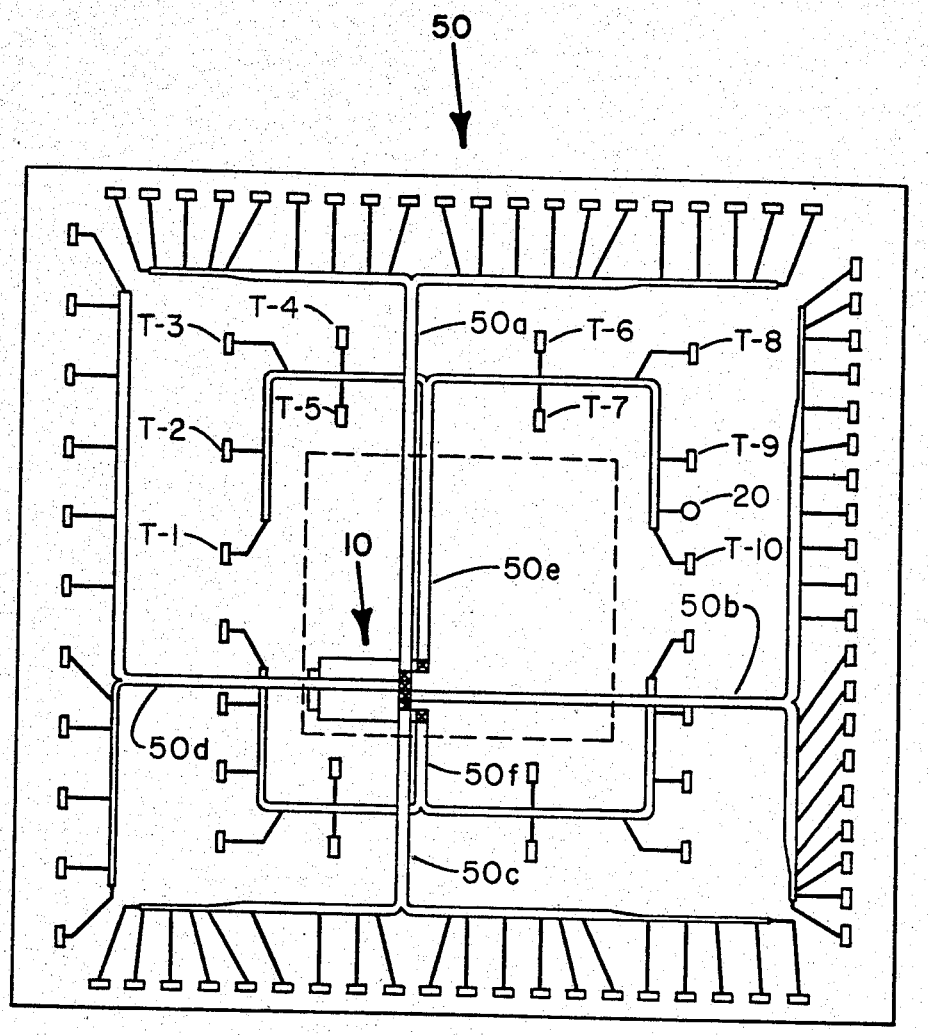
FIG. 1 is a schematic representation of an air distribution system using the present invention.

FIG. 1 illustrates a six zone distribution system 50. The variable volume multizone unit 10 supplies four perimeter zones via ducts 50*a, b, c* and *d,* respectively, and two interior zones via ducts 50*e* and *f,* respectively. The system 50 is under the control of a computer which receives temperature data from a single source in each zone and velocity/volume data for each zone. Dampers located at unit 10 control the flow to each zone. Warm, cool or neutral air is delivered to each zone of the system 50, as required.

As illustrated, the interior zone supplied by duct 50*e* has ten air outlets, T-1 to 10, which are not individually controlled but the total supply of neutral or conditioned air to the zone served by duct 50*e* is responsive to zone temperature sensor 20 and a velocity/volume sensor (not illustrated) which communicate with the computer (not illustrated) controlling unit 10. If, for example, air outlets T-6 and 7 are located in a conference room while air outlets T-1 to 5 and 8-10 are located in normally occupied offices or work areas, the actual demand in the subzone defined by the conference room can be quite different from that sensed by temperature sensor 20. Since the zone is an interior zone, cool air will normally be supplied to air outlets T-1 to 10 which will overcool the conference room when it is unoccupied. Overcooling, or overheating, might be overcome by providing for a shut off of flow to unoccupied subzones as by providing a damper which is only open when the room lights are on as an indication of the room being occupied. Assuming that conditioned air is being delivered to the conference room, the only communication of a heating/cooling demand to the sensor 20 would be as a result of the initiation of supply to the conference room which would reduce the amount of conditioned air reaching the area in which sensor 20 is located. However, because zone temperature sensor 20 is not in the conference room, it may even be subject to a reduced cooling load demand as a result of worker movement to the conference room from the rest of the zone. Any change in the supply of air to the zone is in response to the conditions sensed by sensor 20 and can cause the opening/closing of the dampers and increasing/decreasing of air delivery by the air handling unit of unit 10.

From the foregoing, it is obvious that air outlets T-6 and 7 influence the system only to the extent that they cause sensor 20 to be unsatisfied and, since they only make up 20% of the air outlets in the zone, they can only cause, at most, a 20% change in the air flow to the zone assuming that they can go between blocked/-closed and fully open. Rather than bleeding off air by opening the damper(s) to air outlets T-6 and 7 and permitting otherwise unimpeded flow to air outlets T-8 to 10, the present invention diverts a portion, or even all, of the air normally delivered to air outlets T-8 to 10. The diverting of the flow has two effects. First, three air outlets T-8 to 10, are at least partially taken out of the system so that more flow is directed to all air outlets upstream of the diversion such that the conference room's share can increase to almost 30% (2/7) of the active air outlets. Second, since air delivery to the area in which sensor 20 is located is, at least, reduced, sensor 20 indicates an unsatisfied condition which results in an increased air flow to the zone.

Figure 2:
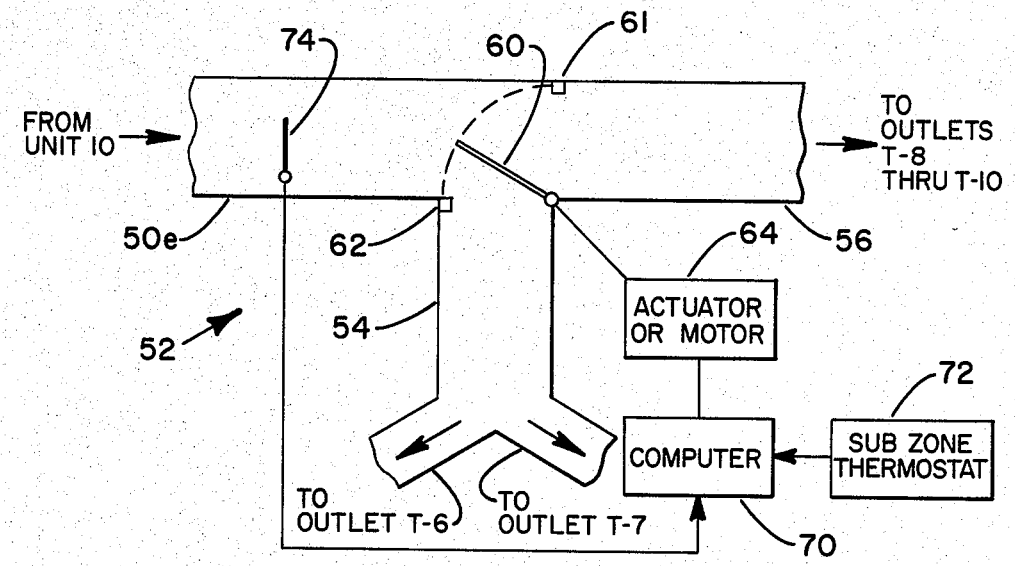
FIG. 2 is a schematic representation of the present invention.

Referring now to FIG. 2, the duct 50*e* forms a tee 52 having a first branch 54 and a second branch 56. Branch 54 delivers the air to the subzone defined by the conference room via outlets T-6 and 7 while branch 56 delivers the air to the outlets T-8 to 10. A splitter damper 60 is located at the intersection of branches 54 and 56. Although damper 60 is illustrated as movable between seats 61 and 62 where it respectively shuts off branches 56 and 54, mechanical stops may be provided to limit movement of the damper with respect to either or both seats. Such a stop may be fixed or adjustable as in the case of threaded member which can be advanced and retracted to engage the damper 60 over a range of positions which define a limit of movement for the damper 60. Alternatively, the movement of damper 60 can be dictated by its actuator or motor 64.

A microprocessor or computer 70 controls the movement or positioning of damper 60. Computer 70 is separate and independent from the computer which has overall control of system 50. Computer 70 receives an input indicative of the temperature in the subzone (conference room) via subzone thermostat 72 and an input indicative of the supply air temperature via temperature sensor 74. Additionally, computer 70 is in 2-way communication with actuator or motor 64 to position the damper 60, as required, and to receive a position feedback.

In operation, the temperature information supplied to computer 70 by temperature sensor 74 causes the subzone to be placed in either the heating or cooling mode. In the heating mode the zone supply air would, typically, be about 85° F. while in the cooling mode it would, typically, be about 55° F., and in the neutral mode would typically be at 70°-75° F. The subzone thermostat 72 furnishes subzone temperature information to computer 70. Assuming that temperature sensor 74 senses a temperature indicative of the cooling mode, a rise of temperature in the subzone to a predetermined setable level indicative of a cooling demand in the subzone causes computer 70 to actuate motor 64 to open the splitter damper 60. The opening of splitter damper 60 diverts or allocates more air to the subzone by opening branch 54 and correspondingly reducing the flow in branch 56. Reduced flow in branch 56 raises the temperature at the downstream location of zone sensor 20 which then indicates an unsatisfied condition to the computer controlling the overall system. The computer then increases the zone supply air by opening the zone damper and/or increasing the air handling unit output. Although there is no direct communication between the computers, the increased zone air supply is under the control of one computer but is in response to action taken by computer 70. The increased zone air supply results in an increased air supply in outlets T-1 to 10. As the subzone served by outlets T-6 and 7 becomes satisfied the position of splitter damper 60 is changed to reduce the amount of air diverted. This, in turn, increases the amount of conditioned air that reaches the location of zone sensor 20. Because there is no direct communication between the computers, they each react to the condition created by the action of the other. However, because computer 70 is able to divert flow to supply the subzone at the expense of the downstream outlets while zone sensor 20 provides the temperature information for the control of the entire zone, the satisfaction of the subzone controls the system response.

In a similar fashion, when the zone is in the heating mode, the splitter damper 60 will be controlled to divert heated air to the subzone served by air outlets T-6 and 7 if the subzone is too cool. If the demand in the subzone is different from that of the air being supplied to the zone, as sensed by temperature sensor 74, the damper 60 will be positioned to shut off, or reduce to a preset minimum, the amount of air of the wrong temperature being supplied to the subzone. Where neutral air is sensed by temperature sensor 74, it will ordinarily be diverted into the subzone in response to either a heating or cooling demand in the subzone. This is the case because neutral air is normally warmer than the heating set point and cooler than the cooling set point because it is primarily return air. It is therefore just a lower quality of heated/cooled air relative to a heating/cooling demand.

Figure 3:
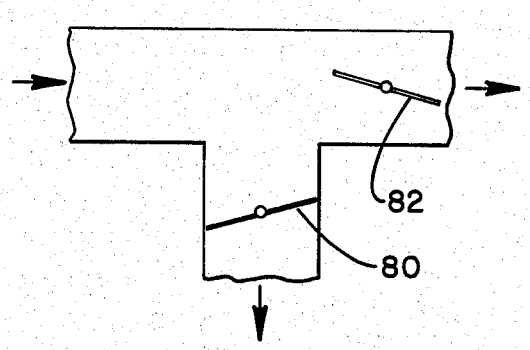
FIG. 3 is a first alternative arrangement of the diverter structure.
Figure 4:
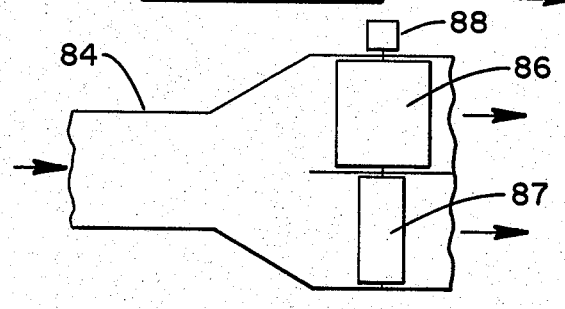
FIG. 4 is a second alternative arrangement of the diverter structure.
Figure 5:
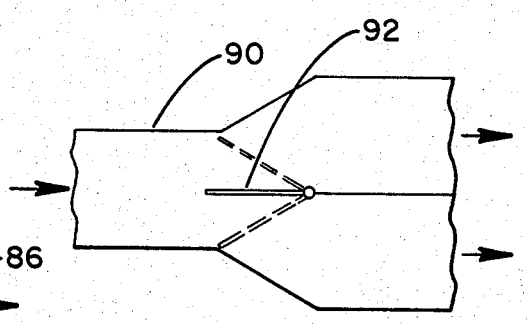
FIG. 5 is a third alternative arrangement of the diverter structure.

Although a single damper 60 at a tee 52 has been described, other configurations are suitable. In FIG. 3, the damper 60 has been replaced by two dampers 80 and 82 which may be either separate or linked. If separate, separate actuators corresponding to actuator 64 would be required whereas if the dampers were linked a single actuator would be required. Otherwise, the device of FIG. 3 would be the same as that of FIG. 2. As illustrated in FIG. 4, the tee 52 of FIG. 2 can be replaced with a wye 84 and two dampers 86 and 87 can replace damper 60. The dampers 86 and 87 would be operated by a single actuator 88. Otherwise, the device of FIG. 4 would be the same as that of FIG. 2. As illustrated in FIG. 5, the tee 52 can be replaced with a wye 90 and damper 60 replaced with damper 92. Otherwise, the device of FIG. 5 would be the same as that of FIG. 2.

Although preferred embodiments of the present invention have been specifically described and illustrated, other changes will occur to those skilled in the art. For example, although the invention is specifically described with respect to temperature, the sensor 20 could be responsive to another characteristic, or combination of characteristics, that go into occupant comfort and make up the load on the system such as humidity and air velocity. It is therefore intended, that the scope of the present invention is to be limited only by the scope of the appended claims.

What is claimed is:

1. In a system in which a plurality of air outlets defining a zone are supplied with a variable quantity of conditioned air in response to conditions sensed at a single sensor location in the zone, a method for providing the required quantity of conditioned air to a subzone served by one or more of the air outlets and located upstream of the sensor location in accordance with demand in the subzone comprising the steps of:

sensing the character of the conditioned air being supplied to the zone;

sensing the demand in the subzone;

if the demand is unsatisfied in the subzone and if the air being supplied to the zone is proper for satisfying the demand, diverting flow of the air to the subzone by at least partially blocking flow past the subzone to reduce the amount of conditioned air reaching the sensor, whereby flow to the sensor location is diminished resulting in a sensed need to increase the amount of conditioned air supplied, causing an increased supply of air to the zone and the entire zone being satisfied.

2. The method of claim 1 further including the step of controlling the amount of air diverted to the subzone according to subzone satisfaction.

3. The method of claim 1 wherein if the demand is unsatisfied in the subzone and if the air being supplied to the zone is not proper for satisfying the demand, further including the step of blocking flow to the subzone.

4. Apparatus for satisfying a variable demand in a subzone of a zone controlled in response to conditions determined at a single location comprising:

means for supplying conditioned air to a plurality of air outlets in the zone;

means for sensing a character of the air being supplied to the zone by the means for supplying conditioned air;

means for sensing zone satisfaction at a single location in the zone supplied with conditioned air by said means for supplying conditioned air;

means for sensing satisfaction in a subzone located upstream of said means for sensing zone satisfaction and some of said air outlets; and means for allocating the conditioned air supplied by said means for supplying conditioned air between said subzone and the air outlets downstream of said subzone and thereby controlling flow to said means for sensing zone satisfaction to cause a change in the flow of conditioned air to the zone.

5. The apparatus of claim 4 wherein said means for allocating the supplied air to said subzone includes a damper means for controlling the amount of air supplied to said subzone and means for positioning said damper means in response to subzone satisfaction.

* * * * *